US010251443B2

(12) United States Patent
Liu et al.

(10) Patent No.: US 10,251,443 B2
(45) Date of Patent: Apr. 9, 2019

(54) DEVICE FOR THREE-DIMENSIONAL FOOT MOTION CONTROL AND PLANTAR PRESSURE REDISTRIBUTION

(71) Applicant: Global Action Inc., Taipei (TW)

(72) Inventors: Keh Tao Liu, Taipei (TW); Sai Wei Yang, Taipei (TW); Tsung-Hsin Chen, Taipei (TW); Hisayoshi Kobayashi, Tokyo-to (JP)

(73) Assignee: Global Action Inc., Taipei (TW)

( * ) Notice: Subject to any disclaimer, the term of this patent is extended or adjusted under 35 U.S.C. 154(b) by 0 days.

(21) Appl. No.: 15/394,201

(22) Filed: Dec. 29, 2016

(65) Prior Publication Data

US 2017/0202299 A1 Jul. 20, 2017

(30) Foreign Application Priority Data

Jan. 15, 2016 (TW) ..... 105101256 A

(51) Int. Cl.

| | |
|---|---|
| ***A43B 7/14*** | (2006.01) |
| ***A43B 7/24*** | (2006.01) |
| ***A43B 17/14*** | (2006.01) |
| ***A43B 17/00*** | (2006.01) |
| ***A43B 17/02*** | (2006.01) |

(52) U.S. Cl.

CPC ..... *A43B 7/24* (2013.01); *A43B 7/141* (2013.01); *A43B 7/142* (2013.01); *A43B 7/143* (2013.01); *A43B 7/144* (2013.01); *A43B 7/1445* (2013.01); *A43B 17/006* (2013.01); *A43B 17/02* (2013.01); *A43B 17/14* (2013.01)

(58) Field of Classification Search

CPC ..... A43B 7/141; A43B 7/142; A43B 7/143; A43B 7/1445; A43B 7/144

See application file for complete search history.

(56) References Cited

U.S. PATENT DOCUMENTS

| | | | | | |
|---|---|---|---|---|---|
| 2,498,624 | A * | 2/1950 | Skinner | A43B 7/14 | 36/180 |
| 3,081,774 | A * | 3/1963 | Lelyveld | A43B 7/142 | 36/174 |
| 4,360,027 | A * | 11/1982 | Friedlander | A43B 7/14 | 36/140 |
| 5,713,143 | A * | 2/1998 | Kendall | A43B 7/14 | 36/145 |
| 6,301,805 | B1 * | 10/2001 | Howlett | A43B 7/142 | 36/145 |

(Continued)

*Primary Examiner* — Ted Kavanaugh

(74) *Attorney, Agent, or Firm* — C. G. Mersereau; DeWitt LLP

(57) ABSTRACT

A device for three-dimensional foot motion control and plantar pressure redistribution, for controlling relative motions of foot joints effectively by modifying heel strike angles and adjusting relative plantar pressures of a foot is disclosed. It includes an arch supporting main body, for supporting medial longitudinal arch, transverse arch and lateral longitudinal arch of the foot, a rear end having at least one lateral side extending corresponding to the location of calcaneus of the foot; wherein the arch supporting main body is a three-dimensional structure formed by curvatures of the medial longitudinal arch, the transverse arch and the lateral longitudinal arch collaboratively, and a hindfoot motion adjustment portion for modifying heel strike angles.

5 Claims, 7 Drawing Sheets

(56) References Cited

U.S. PATENT DOCUMENTS

| | | | | |
|---|---|---|---|---|
| 7,958,653 | B2 * | 6/2011 | Howlett | A43B 7/142 36/35 R |
| D748,387 | S * | 2/2016 | Wert | D2/961 |
| 2004/0025376 | A1 * | 2/2004 | Grisoni | A43B 7/141 36/44 |
| 2004/0181976 | A1 * | 9/2004 | Copeskey | A43B 7/141 36/145 |
| 2007/0289170 | A1 * | 12/2007 | Avent | A61F 5/14 36/166 |
| 2008/0047166 | A1 * | 2/2008 | Conforti | A43B 7/142 36/91 |

* cited by examiner

DEVICE FOR THREE-DIMENSIONAL FOOT MOTION CONTROL AND PLANTAR PRESSURE REDISTRIBUTION

CROSS-REFERENCE TO RELATED APPLICATION

This application claims the priority benefit of Taiwanese Patent Application No. 105101256, filed on Jan. 15, 2016. The entirety of the above-mentioned patent application is hereby incorporated by reference herein and made a part of this specification.

FIELD OF THE INVENTION

The present invention relates to a device for three-dimensional foot support and motion control, used for controlling ankle joint motions and plantar pressure adjustments during motions of a human body.

BACKGROUND OF THE INVENTION

Feet serve as a base for supporting a human body, and each foot is known to comprise of 28 bones, 107 ligaments, 32 muscles, and 57 joints. It is the most complicated musculoskeletal system in the human body. Primary joints thereof comprise an ankle joint, a subtalar joint, a transverse tarsal joint, a metatarsophalangeal joint and an interphalangeal joint.

In general, feet can be classified into 3 different types according to the height of the plantar arch: pes cavus, normal foot and flat foot. During the walking of people with flat feet, normally, due to the fallen arch, there is a greater over pronation during the period from the heel strike to midstance of the feet such that it tends to cause an excessive supination upon the period of push-off of the feet. Consequently, the heel and the metatarsus of people with flat feet would have a higher plantar pressure level comparing to a standard level of people with normal foot. Under normal activities, no special symptom may occur; however, in a long-term period, the feet are likely to produce fatigue, pain or even plantar pathological changes in comparison to those of the people with normal foot, which may also lead to injuries to knee joints and vertebral column joints. For people with flat feet, due to the longer time in excessive pronation on the feet, they prone to cause foot joints, ankle joints and lower limbs to bear excessive strains and the compensatory over internal rotation of hip joints; further leading to excessive pressures and lateral pulling force in medial patella; leading to pain in patella, chronic foot strain, tendinitis, plantar fasciitis, and metatarsalgia.

To keep the balance of body and the stability of forward movements during walking, the relative motions produced by the foot and joints thereof are highly complicated. The foot adjusts motions of each foot joint with tendons, ligaments, and other soft tissues of the foot for the stability while walking and adjusts to different environments. When a human body walks or runs, relative motions between the foot and the ground can be classified into 3 stages: heel rocker, ankle rocker and forefoot rocker. When the foot touches the ground, the reaction force applies on the calcaneus and rapidly increases during the initial contact of heel strike. At this moment the reaction force will reach 40 percent of the weight in 0.05 second; reaching 110 percent to 120 percent of the weight in 0.13 second (loading response). Follow by the forward swinging of body, the center of pressure moves forward from the hindfoot. The reaction force of forefoot reaches over 120 percent of weight during the period of push-off of the foot, and such reaction force is even higher during running.

The lateral side midfoot may occasionally contact with the ground moderately, and the reaction force of this area is often only 10 percent of the body weight. The pressure of metatarsus varies accordingly with differences of each individual. Usually the highest pressure level appears between the $2^{nd}$ and $3^{rd}$ metatarsals. People with pes cavus have higher plantar pressure in the hallux and $1^{st}$ metatarsal. People with low arch or flatfoot usually have higher plantar pressure in the 1st, 2nd, 3rd metatarsals and heel.

During the walking of people with pes cavus, due to the insufficient tibial internal rotation affecting under pronation, they tend to have an excessive supination during push-off, which further leads to stiff walking postures and causing muscular and skeletal problems with high arch. The ankle joint has bigger flexion motion during ankle rocker to compensate the over plantar flexion angle of metatarsus and to increase the clearance altitude of the point of foot during push off. In addition, high arch runners clearly bear more impact forces than low arch runners do.

Genu Valgum and Genu Varum: the foot is constructed by a femur, a tibia, a fibula and a patella. When doing an X-ray photography research, a normal angle between tibia and femur diaphysis is outward 6° when observing in the coronal plane; Genu Valgum (X-leg) or Genu Varum (O-leg) is called if the angle is too big or too small. An easy clinically observing way would be making an individual put both knees forward and both medial side ankles together; if the width of at least two fingers can be put in between both knees, wherein, calling Genu Varum will cause excessive tibia external rotation and excessive forefoot supination while walking. The abnormal use of lower limb muscles further leads to pain in medial side of knees and metatarsus or even osteoarthritis. If an individual can put the width of at least two fingers in between medial side of ankles when both knees are put together, thereof is called Genu Valgum. This type of lower limbs causes knees and ankles to roll inward while stepping forward; in a long term, malaise of lateral knee joints and plantar fasciitis may occur.

Customized foot orthoses can increase contact area, rearranging forces to reduce plantar pressure. In current years, foot orthoses are commonly used in amending and assisting walking for foot dysfunctions that are caused by poor foot structure or other problems in the musculoskeletal system. Since 1983, research studies have demonstrated that foot orthoses can reduce symptoms of lower limbs. Such devices may be able to reduce the pains caused by plantar fasciitis by 80%, in addition to that it is able to facilitate the healing of the feet of injured runners.

Another significant purpose of foot orthoses is to make biomechanical behaviors to become normal. Many researches show that foot orthoses can reduce pronation or motion speed on the hindfoot. The arch supportive insole affects lower limb motions obviously; during running, it is able to reduce the tibia internal rotation by 2° for an early period of 50% time of standing. Such influence on the tibia axial rotation and varus and valgus of calcaneal is able to lower internal and external rotation speeds and tibia internal rotation angles in order to further reduce the plantar pressure at the hallux and the medial side of heel by 30%~40%.

Known arch supportive insoles mainly provide a compensation of a raised height beneath the navicular by using an insole to compensate the plantar arch heights of pes cavus or flat foot in order to allow the foot to absorb impact and to achieve the effect of distributing the human body weight.

Although known arch support insoles are helpful to muscular soreness associated with flat foot or pes cavus, the method can only raise the navicular medial side of midfoot such that it is only helpful in improving relative movements of midfoot and forefoot. For patients of flat feet with valgus heel or having pes cavus with under pronation, the motions of the subtalar joint cannot be effectively improved. Said damage to the musculoskeletal system still remains to exist for those using such known arch supportive insoles for exercises in a long term.

In view of the drawbacks of the known technique, the inventor of the present invention provides a device for three-dimensional foot motion control and plantar pressure redistribution, and said device for three-dimensional foot motion control and plantar pressure redistribution can be used for supporting the plantar arch and calcaneus without occupying excessive interior space of shoes, adjusting excessive subtalar joint valgus and varus, modifying angles of ankle supination and pronation, reducing improper motions of lower limb muscles; thereby, improving muscular soreness during walking or running, and reducing damage to skeletons and muscles.

CONTENT OF INVENTION

The purpose of the present invention is to overcome deficiencies of the prior arts by providing a device for three-dimensional foot motion control and plantar pressure redistribution in order to achieve the effect of controlling the relative movements of foot joints, moderating relative plantar pressures and reducing improper impacts on the lower limb muscles.

The present invention provides a device for three-dimensional foot motion control and plantar pressure redistribution for controlling relative motions of foot joints effectively and adjusting the heel strike angle and relative plantar pressures thereof including one arch support body. Said arch support body is used for supporting the medial longitudinal arch, transverse arch and lateral longitudinal arch. At least one side of the rear end of said arch support body extends to one hindfoot motion adjustment portion to the corresponding calcaneus to adjust the heel strike angle. Said arch support body is a three-dimensional structure that is compatibly constructed by curvatures of the medial longitudinal arch, transverse arch and lateral longitudinal arch.

In one embodiment, the hindfoot motion adjustment portion at the rear end of said arch supporting main body extends backwardly from a corresponding cuboid laterally and rearward to the calcaneus.

In one embodiment, the hindfoot motion adjustment portion at the rear end of said arch supporting main body of said plantar movement adjusting part extends from a corresponding navicular medially and rearward to calcaneus.

In one embodiment, said hindfoot motion adjustment portion comprises a first hindfoot motion adjustment section and a second hindfoot motion adjustment section; the first hindfoot motion adjustment section at the rear end of the arch supporting main body extends from a corresponding navicular medially and rearward to calcaneus; the second hindfoot motion adjustment section at the rear end of the arch supporting main body extends from a corresponding cuboid laterally and rearward to calcaneus.

In one embodiment, the device for three-dimensional foot motion control and plantar pressure redistribution further comprises a rigid reinforcement portion disposed at a surface of said arch supporting main body and extending from a middle section at the rear end of arch supporting main body to a corresponding lateral longitudinal arch of the foot.

In one embodiment, the device for three-dimensional foot motion control and plantar pressure redistribution further comprises a rigid reinforcement portion disposed at a surface of said arch supporting main body and extending from a middle section at the rear end of the arch supporting main body to a corresponding medial longitudinal arch of the foot.

In one embodiment, the device for three-dimensional foot motion control and plantar pressure redistribution further comprises a rigid reinforcement portion disposed at a surface of said arch supporting main body and extending from a middle section at the rear end of the arch supporting main body forward to the center of arch supporting main body.

In one embodiment, said hindfoot motion adjustment portion appears roughly hook-shaped.

In one embodiment, the arch supporting main body includes a proximal metatarsal supporting portion formed corresponding to the first metatarsal of the foot.

In one embodiment, the arch supporting main body and the hindfoot motion adjustment portion are made of a plastic, a glass fiber, a carbon fiber blend or a metal material.

As previously mentioned, the present invention of the device for three-dimensional foot motion control and plantar pressure redistribution is of the following merits:

(1) When a human body is in moving motions, the device for three-dimensional foot motion control and plantar pressure redistribution can efficiently control motions of subtalar joint to adjust excessive angles of pronation and supination. Using the rigid support of hindfoot motion adjustment portion to control excessive or deficient angles of pronation and supination at foot joints in a normal range which further adjust and redistribute plantar pressures; consequently, reducing improper motions of lower limb muscles, improving muscles soreness from walking or running, reducing damages to skeletons and muscles.

(2) The device for three-dimensional foot motion control and plantar pressure redistribution adjusts the heights of plantar arch, controlling motions of midfoot and forefoot regularly, reducing irregular plantar pressures during motions following by the impact of reaction force to the ground; at the same time without increasing the thickness of the foot arch supporting portion; therefore without occupying excessive interior space in shoes to make them comfortable to wear.

The above "CONTENT OF THE INVENTION" is not used in limiting the scopes of proposal. Each brief description of the present invention will be further described in the below practicing method paragraph.

DETAILED DESCRIPTION OF THE INVENTION

To describe the technical contents, structural features, reached purposes and effects of the present invention in detail, providing embodiments with figures to explain details in the following.

The main purpose of the present invention is providing a device for three-dimensional foot motion control and plantar pressure redistribution to control the relative motions of foot joints efficiently then adjusting foot strike angles, relative plantar foot pressures and reducing improper use of lower limb muscles.

Figure 1:
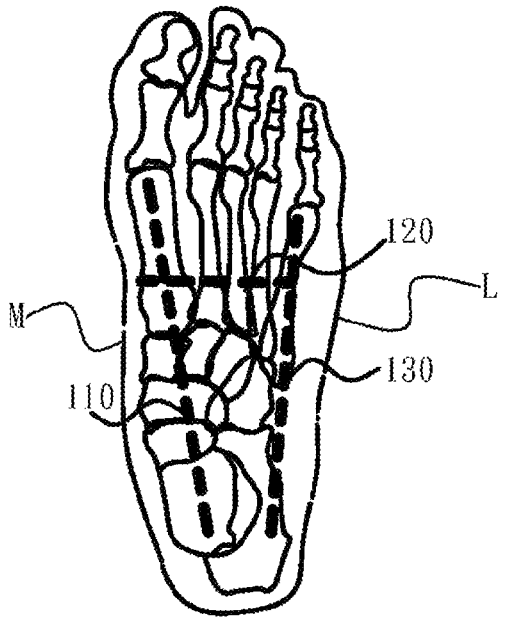
FIG. 1 is the position of right plantar arch and corresponding bones in human bodies.
Figure 1:
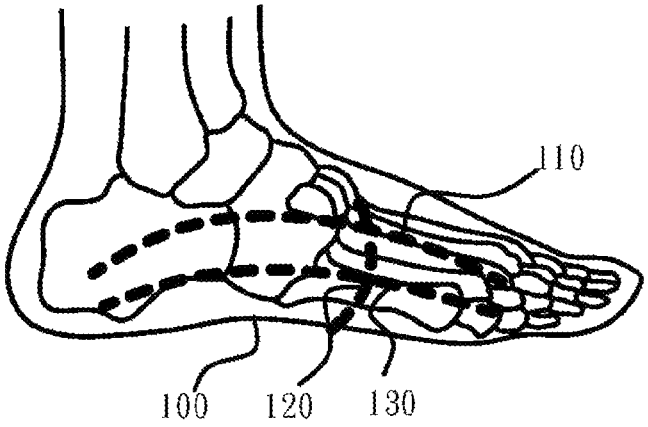

Referring to FIG. 1, human foot has plantar arch 100 to absorb impacts and redistribute the weight of human body. Said plantar arch 100 contains the $1^{st}$ metatarsal, $1^{st}$ cuneiform bone, navicular and talus of the foot along the medial side of foot hunching-up to form one medial longitudinal arch 110. One transverse arch 120 is formed between the $1^{st}$ metatarsal and $5^{th}$ metatarsal. One lateral longitudinal arch 130 is formed between the $5^{th}$ metatarsal and calcaneus. When a human body is in motions, said medial longitudinal arch 110, transverse arch 120 and lateral longitudinal arch 130 together absorb impacts and redistribute the weight of human body. When said plantar arch 100 is too high, pes cavus is caused or too low, flat foot or low arch is caused; the abnormal plantar pressure is caused as well.

Figure 2:
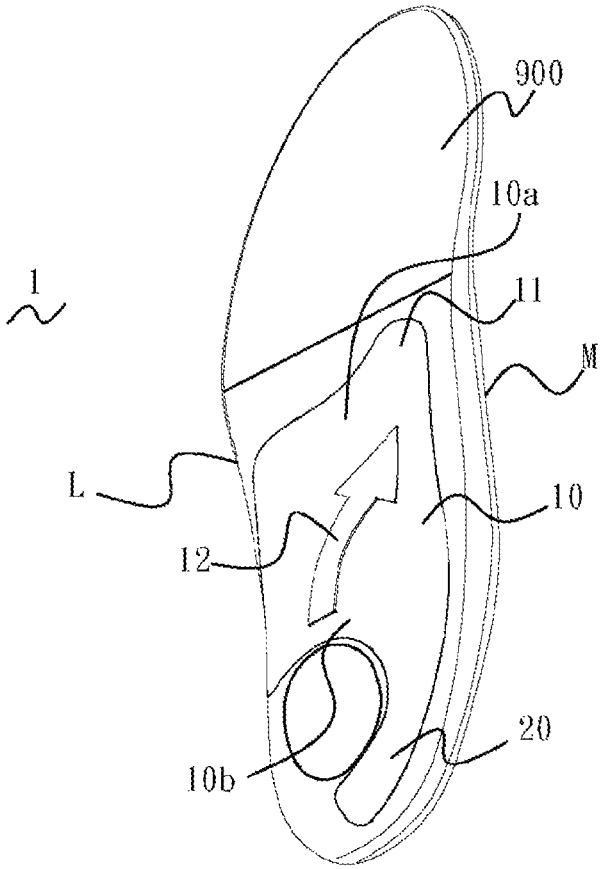
FIG. 2 is an illustration of a device for three-dimensional foot motion control and plantar pressure redistribution in the present invention, corresponding to the right foot thereof and having excessive valgus and over pronation at ankle joint motions. For example: flat foot and low plantar arch foot type use only.

Referring to FIG. 1 and FIG. 2, in order to achieve the above purpose, the present invention provides one device for three-dimensional foot motion control and plantar pressure redistribution 1, containing one arch support body 10 and one hindfoot motion adjustment portion 20. Said arch support body 10 is a three-dimensional structure that is compatibly constructed by the curvatures of the medial longitudinal arch 110, transverse arch 120 and lateral longitudinal arch 130, using for supporting said medial longitudinal arch 110, transverse arch 120 and lateral longitudinal arch 130. Said arch support body 10 contains one front end 10*a* and one rear end 10*b*. At least one side of rear end 10*b* of said arch support body 10 extends one hindfoot motion adjustment portion 20 toward to the corresponding foot calcaneus position to adjust heel strike angle and control hindfoot motions. The device for three-dimensional foot motion control and plantar pressure redistribution 1 of the present invention also can be disposed in one plantar arch insole 900.

Front end 10*a* of said arch support body 10, wherein, corresponding to proximal metatarsal supporting portion 11 at the $1^{st}$ metatarsal of foot. As the proximal support of $1^{st}$ metatarsal, said proximal metatarsal supporting portion 11 is used in providing the stability of forefoot and reducing forces to toes during push off. Said arch support body 10 and said hindfoot motion adjustment portion 20 can be chemical or metal material and can support forces such as metal, plastics, glass fiber or carbon fiber blend.

Referring to FIG. 2, said hindfoot motion adjustment portion 20 extends backwardly from the navicular side, wherein, corresponding to said rear end 10*b* of said arch supporting main body 10 (i.e. a supporting main body) to calcaneus and appearing roughly hook-shaped; used for adjusting the heel strike angles of low arch or flat foot thereof.

During the moving process of human body, because of foot will periodically have three-dimensional motions of supination or pronation, high or low height of plantar arch produces supination or over pronation during the process of walking. Such as O-leg may come with high arch foot type; over supination is produced when the heel strikes so excessive varus of ankle joints happens in the loading response. X-leg may come with flatfoot type; over pronation is produced when the foot strikes, excessive valgus of ankle joints happens in the loading response. Excessive or deficient pronation or supination will produce abnormal plantar pressures which has a great damage to human bodies. Said hindfoot motion adjustment portion 20 can compensate excessive angles of valgus and varus while the foot striking the ground to prevent damage to human bodies.

Figure 3:
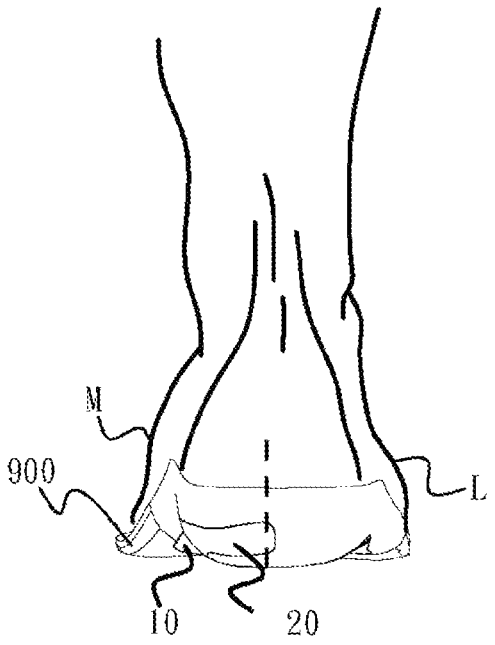
FIG. 3 is an illustration of a flat foot patient using the device for three-dimensional foot motion control and plantar pressure redistribution in FIG. 2.

To further explain, the heel strike angle is adjusted with the support of said hindfoot motion adjustment portion 20 (i.e. a motion adjustment portion) which can adjust relative motions of foot joints. While treading, because of ankle joints shift toward to medial side M, over pronation is appeared. With the rigid foot support part of said hindfoot motion adjustment portion 20, ankle joints shift toward to lateral side L to keep ankle joint angle normal while treading; as shown in FIG. 3, further adjusting the plantar pressure distribution of flatfoot. In addition, the heel will be modified to a softer position of insole to change the ankle joint strike angle to prevent damages from flatfoot to human bodies after the foot touches the ground with the rigid support of said hindfoot motion adjustment portion 20.

Figure 4:
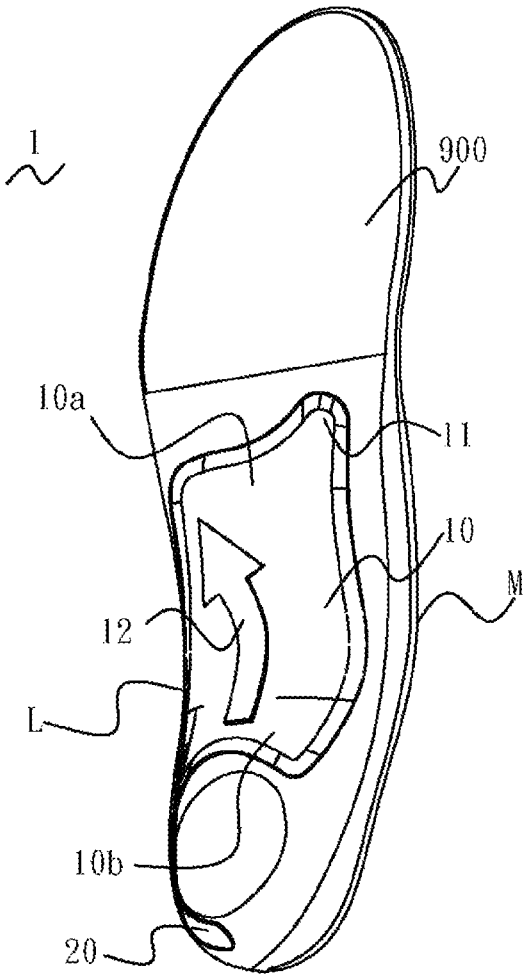
FIG. 4 is an illustration of one embodiment for the device for three-dimensional foot motion control and plantar pressure redistribution in the present invention which is corresponding to the right foot as ankle motions with excessive varus and under pronation. For example: high plantar arch foot type use only.
Figure 5:
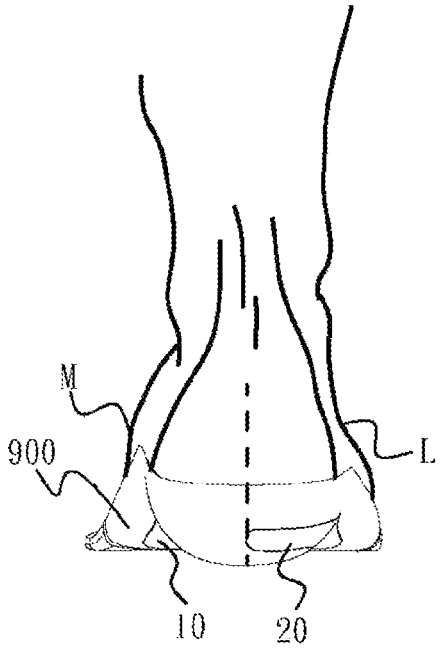
FIG. 5 is an illustration of high plantar arch foot type in FIG. 4 using the device for three-dimensional foot motion control and plantar pressure redistribution.

Referring to FIG. 4, in one embodiment, said hindfoot motion adjustment portion 20 extends backwardly from the cuboid bone side that is corresponding to said rear end 10*b* of said arch supporting main body 10 to calcaneus and appears roughly hook-shaped to support the foot of high arch foot type. While treading, because of ankle joints overly shift toward to lateral side L, over supination is appeared. With the rigid foot support part of said hindfoot motion adjustment portion 20, ankle joints shift toward to medial side M to keep ankle joint angle normal while treading; as shown in FIG. 5, further adjusting relative motions of foot joints. In addition, the heel will be modified to a softer position of insole to change the ankle joint strike angle to prevent damages from high arch feet to human bodies after the foot touches the ground with the rigid support of said hindfoot motion adjustment portion 20.

Figure 6:
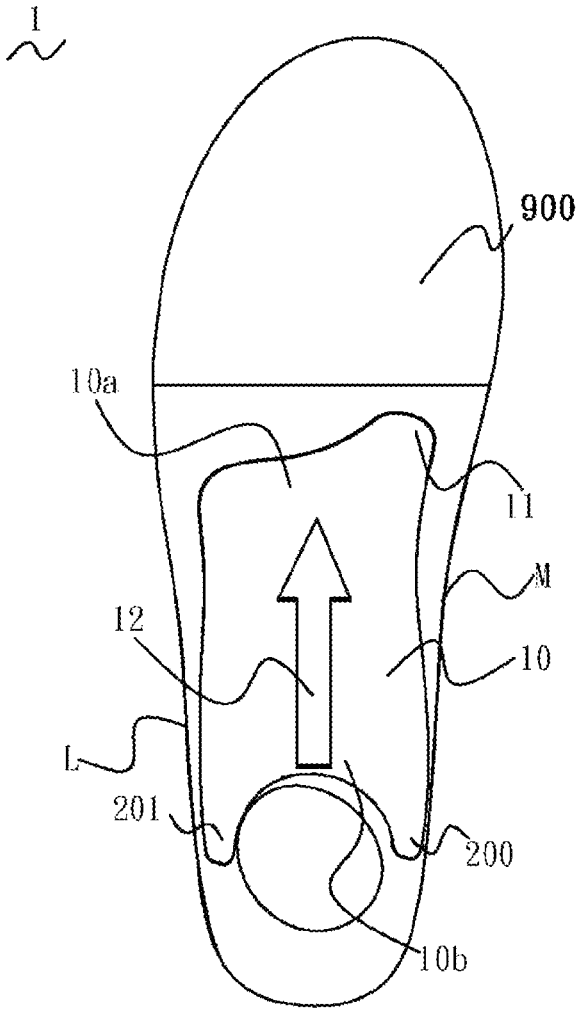
FIG. 6 is an illustration of one embodiment of the device for three-dimensional foot motion control and plantar pressure redistribution in the present invention, relating to normal plantar arch foot type use only thereof.
Figure 7:
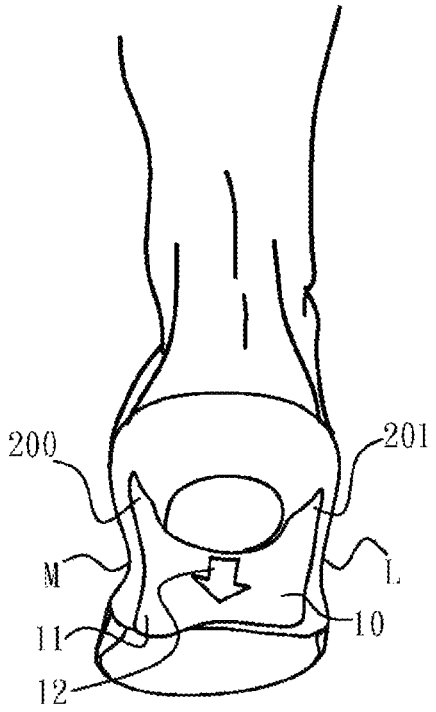
FIG. 7 is an illustration of normal plantar arch foot type in FIG. 6 using the device for three-dimensional foot motion control and plantar pressure redistribution.

Referring to FIG. 6, in another embodiment, said hindfoot motion adjustment portion 20 contains one first hindfoot motion adjustment section 200 and one second hindfoot motion adjustment section 201. Said first hindfoot motion adjustment section 200 is near to the navicular side that is corresponding to said arch support main body 10, wherein, extending backwardly to the middle part of calcaneus. Said second hindfoot motion adjustment section 201 is near to the cuboid bone side that is corresponding to arch support main body 10, wherein, extending to the middle part of calcaneus to support the foot of normal arch foot type. As shown in FIG. 7, said first hindfoot motion adjustment section 200 and said second hindfoot motion adjustment section 201 are not limited in extending to calcaneus; the purpose thereof is disposing on two sides on calcaneus to provide a support to heel. While treading, human bodies may change foot strike angle for losing balance; thereby supports of first hindfoot motion adjustment section 200 and second hindfoot motion adjustment section 201 can stabilize the foot.

Additionally, arch support main body 10 which is compatibly constructed by the curvatures of said medial longitudinal arch 110, transverse arch 120 and lateral longitudinal arch 130 can control the stability in dynamic motions with disposing one rigid reinforcement portion 12. Said rigid reinforcement portion 12 is an upward convex object on the surface of arch support main body 10 or a solid body combined with the surface of arch support main body 10. Referring to FIG. 2, said rigid reinforcement portion 12 which is used for flatfoot type, disposing on the surface of arch support main body 10; it continues to extend from the middle part of rear end 10*b* of arch support main body 10 to the position of medial longitudinal arch 110. So the rigidity of foot arch support body of medial side can be greater than of the lateral side of foot; thereby increasing the rigidity of arch support body and reducing the level of foot dropping for medial longitudinal arch 110 in dynamic motions.

Referring to FIG. 4, said rigid reinforcement portion 12 which is used for high arch foot type, extending from the middle part of rear end 10*b* in arch support main body 10 to the position of lateral longitudinal arch 130 which is corresponding to the foot; thereby increasing the rigidity of arch support body and reducing the level of foot dropping for lateral longitudinal arch 130 in dynamic motions.

Referring to FIG. 6, said rigid reinforcement portion 12 thereof which is used for normal arch foot type, extending from the middle part of rear end 10*b* in arch support main body 10 to the middle part of front end 10*a* to increase the supporting rigidity in the middle of arch support main body 10. Because of the thicknesses and rigidity of medial longitudinal arch 110 and lateral longitudinal arch 130 are roughly the same, the rigidity in the middle part is greater than medial and lateral sides; the dropping level of medial longitudinal arch 110 and lateral longitudinal arch 130 in dynamic motions are roughly the same as well.

To further explain, said rigidity reinforcement portion 12 on the surface of arch support main body 10 can modify the foot over pronation or over supination to normal strike angle with different positions that are disposed by said rigid reinforcement portion 12; controlling the distribution of the rigidity on the surface of arch support main body 10 and reducing the foot dropping level in the corresponding plantar arch position in order to adjust and control the distribution of plantar pressures.

When a human body walks, gait cycle involves swing phase and stance phase. In which stance phase occupies about sixty percent of the time in the entire gait cycle therefore it is significant to keep the stability of stance phase. The device for three-dimensional foot motion control and plantar pressure redistribution 1 in the present invention can modify angles of pronation or supination to provide a stable gait for the corning stance phase.

When a human body is in movements, the device for three-dimensional foot motion control and plantar pressure redistribution 1 can control the movements of subtalar joint efficiently to adjust excessive angles by pronation and supination. Using the rigid support of hindfoot motion adjustment portion 20 to control excessive or deficient valgus and varus angles of foot joints in a normal range in order to modify and redistribute the plantar pressure in each plantar area; thereby, reducing improper movements of lower limb muscles, improving muscle soreness during walking or running and reducing damages to skeletons and muscles.

The device for three-dimensional foot motion control and plantar pressure redistribution adjusts the heights of plantar arch regularly with the impact of reaction force to the ground during motions, controlling motions of midfoot and forefoot, reducing irregular plantar pressure, at the same time not increasing the thickness of the foot arch supporting portion; therefore without occupying excessive interior space in shoes, making them comfortable to wear.

In summary, the device for three-dimensional foot motion control and plantar pressure redistribution in the present invention provides a method to control relative movements of foot joints efficiently. With the structure of the present invention, the foot appears to be in a stable gait under motions in order to stabilize the motions of human bodies and raising the efficiency of exercising to satisfy the needs of normal people to professional runners.

The preferred embodiments of the present invention have been disclosed in the examples. However, the examples should not be constructed as a limitation on the actual applicable scope of the invention, and as such, all modifications and alterations without departing from the spirits of the invention and appended claims shall remain within the protected scope and claims of the invention.

What is claimed is:

1. A device for three-dimensional foot motion control and plantar pressure redistribution, used for controlling relative motions of foot joints effectively by modifying heel strike angles and adjusting relative plantar pressures of a foot, comprising:

supporting main body, used for supporting medial longitudinal arch, transverse arch and lateral longitudinal arch of the foot, comprising a rear end having at least one lateral side extending to the location of the supporting main body corresponding to a calcaneus of the foot; said supporting main body is a three-dimensional structure formed by curvatures adapted to the medial longitudinal arch, the transverse arch and the lateral longitudinal arch collaboratively;

a motion adjustment portion, used for modifying heel strike angles; and a single rigid reinforcement portion disposed at a surface of said supporting main body and extending only from a middle section of the supporting main body to a location of the supporting main body corresponding to lateral longitudinal arch of the foot.

2. The device for three-dimensional foot motion control and plantar pressure redistribution according to claim 1, wherein the motion adjustment portion at the rear end of said supporting main body extends backwardly from a location of the motion adjustment portion corresponding to a cuboid laterally and rearward to a location of the motion adjustment portion corresponding to the calcaneus.

3. The device for three-dimensional foot motion control and plantar pressure redistribution according to claim 1, wherein said motion adjustment portion appears roughly hook-shaped.

4. The device for three-dimensional foot motion control and plantar pressure redistribution according to claim 1, wherein the supporting main body includes a supporting portion formed at a location of the supporting main body corresponding to a first metatarsal of the foot.

5. The device for three-dimensional foot motion control and plantar pressure redistribution according to claim 1, wherein a material of the supporting main body and the motion adjustment portion are selected essentially from the group consisting of a plastics, a glass fiber, a carbon fiber blend and a metal material.

* * * * *